US006100846A

United States Patent [19]

Li et al.

[11] Patent Number: 6,100,846

[45] Date of Patent: Aug. 8, 2000

[54] FIXED PATCH ARRAY SCANNING ANTENNA

[75] Inventors: David D. Li, Batavia; Xiao-Dong Wu, St. Charles; Kenneth D. Gilliam, Yorkville; Robert M. Knox, Geneva, all of Ill.

[73] Assignee: Epsilon Lambda Electronics Corp., Geneva, Ill.

[21] Appl. No.: 09/265,278

[22] Filed: Mar. 9, 1999

[51] Int. Cl.[7] ..... H01Q 1/38; H01Q 1/48

[52] U.S. Cl. ..... 343/700 MS; 343/829; 343/848

[58] Field of Search ..... 343/700 MS, 829, 343/846, 848; H01Q 1/38, 1/48

[56] References Cited

U.S. PATENT DOCUMENTS

| | | | |
|---|---|---|---|
| 4,667,201 | 5/1987 | Itoh | 342/371 |
| 4,691,208 | 9/1987 | Stern et al. | 343/785 |
| 5,504,466 | 4/1996 | Chan-Son-Lint et al. | 343/700 MS |
| 5,694,134 | 12/1997 | Barnes | 343/700 MS |
| 5,712,644 | 1/1998 | Kolak | 343/700 MS |
| 5,923,290 | 7/1999 | Mikami et al. | 343/700 MS |

*Primary Examiner*—Don Wong
*Assistant Examiner*—Hoang Nguyen
*Attorney, Agent, or Firm*—John L. Schmitt

[57] ABSTRACT

An antenna, particularly adapted to produce a scanning beam usable for radar and communication applications, includes a frame. Attached to the frame is a reciprocating device that is operatively connected to a reflecting conductor. Spaced by a uniform gap from the conductor is an elongated dielectric waveguide carried on a conductive layer of a laminate supported by the frame on an input side of the antenna. The waveguide covers a set of spaced apart apertures in the laminate conductive layer. Joined to the laminate conductive layer on an opposite output side of the antenna is a dielectric layer. On an outer surface of the laminate dielectric layer is a set of spaced apart conductive patches that align with the laminate conductive layer apertures. During operation of the antennas an electromagnetic wave is transmitted through the waveguide to pass through the laminate apertures and energizes the patches. At the same time, the reflecting conductor moves back and forth toward the waveguide to vary the uniform gap to induce a phase shift in the electromagnetic wave passing therethrough. Electromagnetic energy from the energized patches combines in phase to form an outward projecting beam of radiated energy that scans from side-to-side.

12 Claims, 9 Drawing Sheets

FIXED PATCH ARRAY SCANNING ANTENNA

BACKGROUND OF THE INVENTION

1. Field of the Invention

This invention relates generally to scanning beam antennas and more particularly a fixed antenna that generates a scanning beam useful for radar and communication system applications.

2. Prior Art

Known scanning antennas heretofore included phase shifting antennas utilizing ferrite materials. One such phase shifting device is disclosed in U.S. Pat. No. 4,691,208. This device includes a ferrite plate surrounding a dielectric waveguide.

Generally, ferrite phase shifters are readily adaptable into antenna systems at microwave frequencies up to 20 GHz. Above that frequency, they are not particularly usable. Limitations of ferrite phase-shifting antennas include requiring a substantial power input to effect a phase change, high insertion loss, and requiring circuity not easy to integrate.

An electronic scanning antenna is shown in U.S. Pat. No. 4,667,201. While this antenna provides a wide range of scanning angles, its phase shifter is expensive especially in millimeter wave frequencies.

Another scanning array antenna is described in a paper authored by M-Y Li, S. Kanamalura, and K. Chang, entitled, Aperture-Coupled Microstrip Antenna Array Fed By Dielectric Image Line, and published in *Electronics Letters*, pp. 1105–1106, Vol. 30, No. Jul. 14, 1994. Structure of the discussed antenna is quite simple. In this case, the required phase shifting is effected by operating at different frequencies. Frequency scanning antennas have several limitations, however. First, the frequency bandwidth must be quite wide to obtain an effective scanning angle range. However, the needed frequency bandwidth may not comply with frequency bandwidth uses established by the Federal Communication Commission (FCC). Secondly, frequency scanning antennas cannot be used with radar or communication systems utilizing frequency modulation mechanisms.

Another scanning array antenna is disclosed in U.S. Pat. No. 5,504,466. This antenna uses a suspended dielectric and microstrip type microwave phase shifter. While this phase shifter can be easily integrated with other circuitry, there are substantial fabrication costs. These higher costs relate to needs for a large microwave laminate for the antenna substrate and special dielectric materials for the phase shifter. Also, this antenna is inefficient because of high circuit loss in the microstrip power splitter and phase shifter.

SUMMARY OF THE INVENTION

An antenna of this invention that is particularly adapted to produce a scanning beam usable for radar and communication applications includes a frame. Attached to the support frame on an input side of the antenna is a reciprocating device that is operatively connected to a movable conductor. Spaced from the conductor is a conductive layer of a laminate. The laminate conductive layer is formed with a set of spaced apart, aligned apertures. These apertures than are covered by an elongated dielectric waveguide. The waveguide is attached to an outer surface of the laminate conductive layer and spaced from the movable conductor to form a uniform gap therebetween.

Joined to the conductive layer of the laminate on an input side of the antenna is a dielectric layer. On an outer surface of the laminate dielectric layer is a set of conducting patches that conductively align with the laminate conductive layer apertures.

For use, an electromagnetic wave is transmitted through the waveguide. This wave disseminates through the laminate conductive layer apertures to respectively energize the patches.

Electromagnetic energy from the energized patches then combines to form an outward projecting, fan-shaped beam of radiated energy. This beam is positioned perpendicular to the plane of the laminate. Concurrent with energizing the patches, the reflecting conductor reciprocates back and forth toward the dielectric waveguide to vary the uniform gap and produce a phase shift in the electromagnetic wave propagating in the waveguide. The phase shifting of the wave causes the beam to scan left and right in alignment with the patches.

The antenna of this invention produces several advantages over scanning antennas known or now in use.

A first advantage of this inventive antenna is that its operation requires minimal mechanical input. Structure producing this input is simple, inexpensive, and highly reliable. Any required service is easily performed by a semi-skilled technician.

A second advantage is that the antenna structure is light weight and compact. This characteristic is particularly valuable where this inventive antenna is adapted for use in motor vehicles and aircraft radar systems.

A third advantage is that structure of the antenna may be adapted to produce one-directional and two-directional scanning. Where used in a radar system, for example, detection capability may be tailored to the anticipated spacial positioning of the object to be detected.

A fourth advantage is that the patches of antenna may be arranged in varying arrays to form different beam configurations.

Lastly, by changing the size of the patches and the configuration of the dielectric waveguide for example, t he antenna may be adapted to operate at different frequencies for example in a range from one to one thousand GizaHerz. Thus, the antenna structure may have different end uses in conformance with governmental regulation, such as published by the FCC.

DESCRIPTION OF THE DRAWING FIGURES

Figure 1:
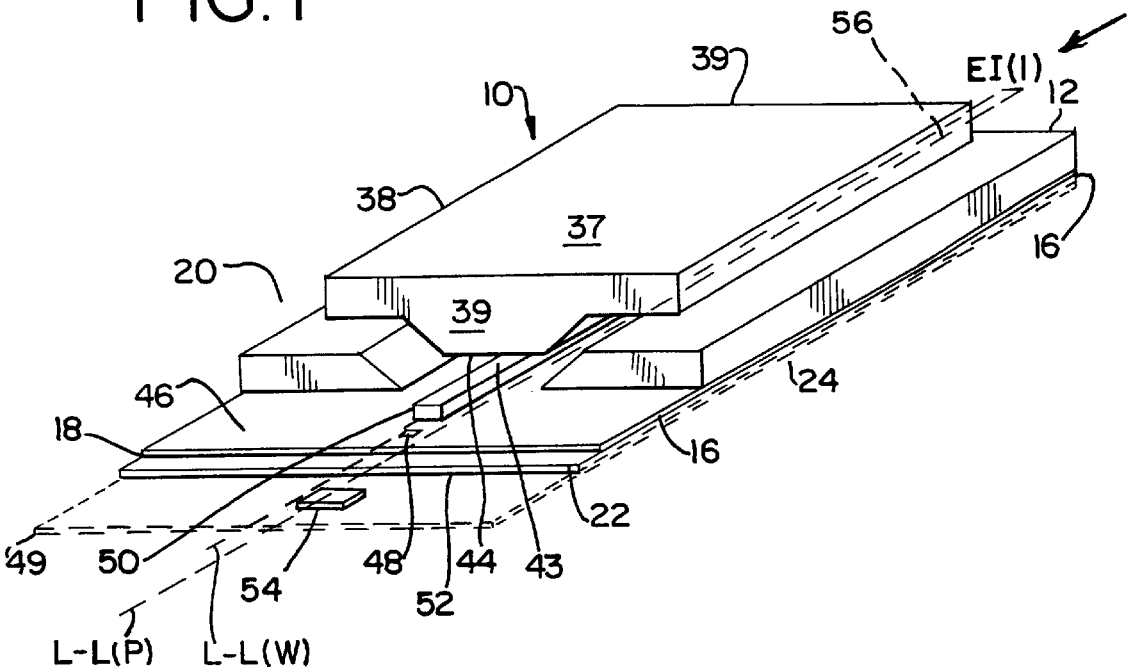
FIG. 1 is a perspective view of an input side of an antenna of this invention shown without a reciprocating device.

FIG . 3A is a detailed plan view of a portion of a laminate of the antenna of FIG. 1 showing offsetting of apertures in the laminate.

Figure 4:
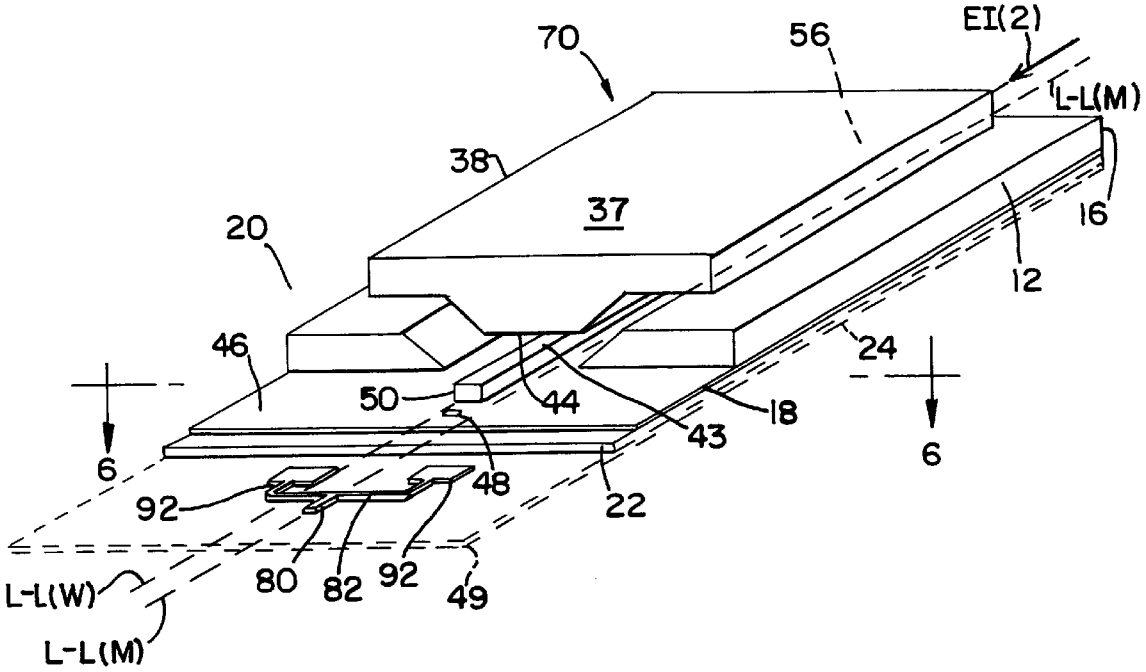

FIG. 4 is a perspective view of an input side of a further antenna embodiment of this invention that again is shown without a reciprocating device.

Figure 5:
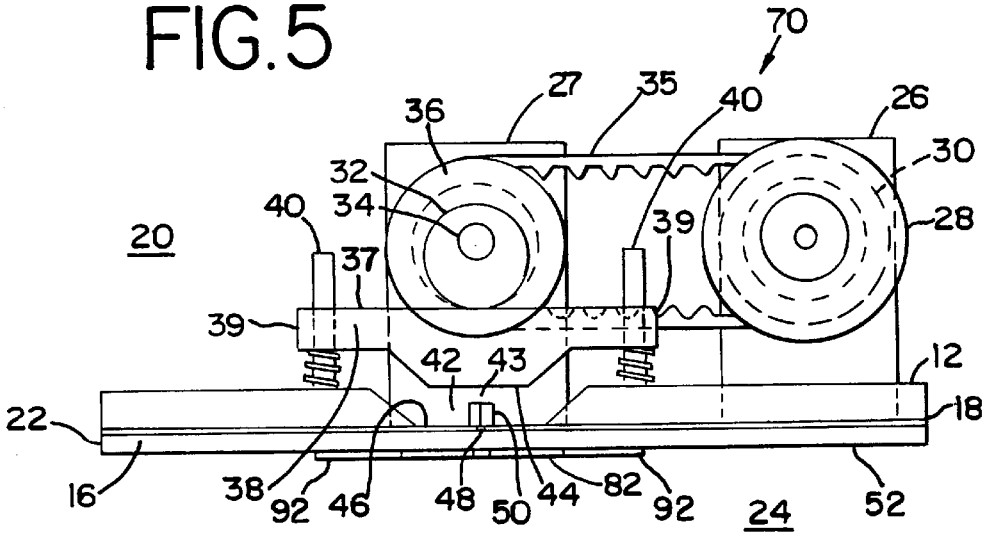

FIG. 5 is an end elevational view of the antenna shown in FIG. 4.

Figure 6:
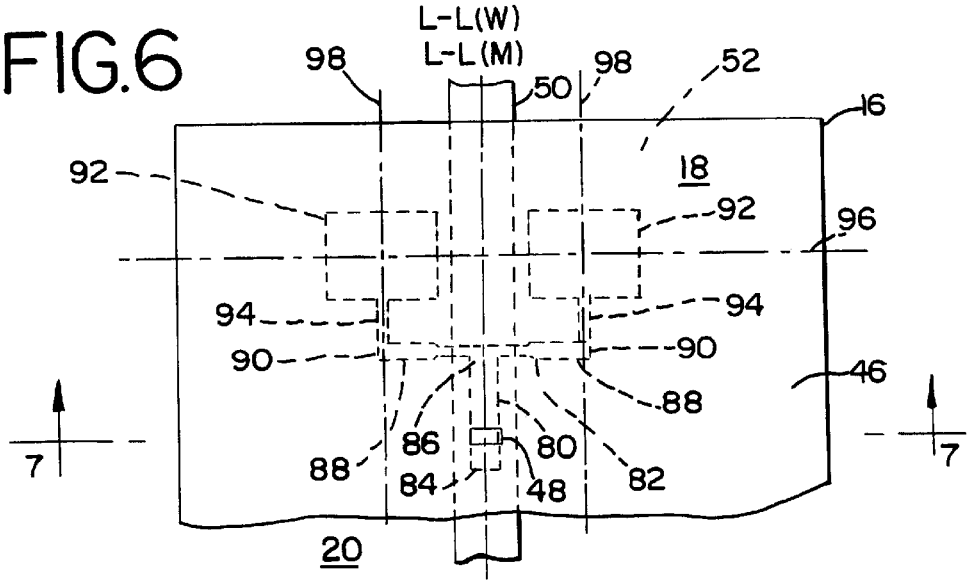

FIG. 6 is a cross-sectional view as seen generally alone to line 6—6 in FIG. 4 showing one pair of patches.

Figure 7:
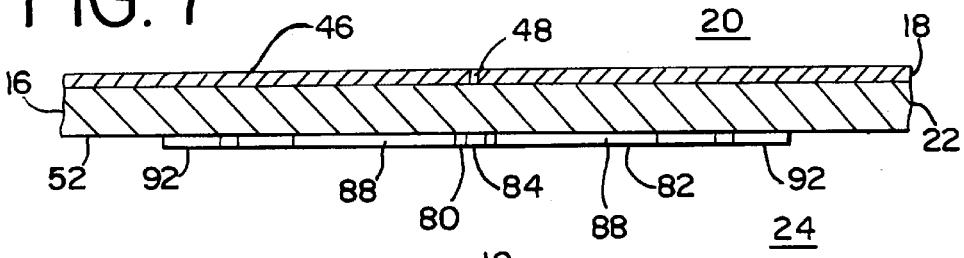

FIG. 7 is a cross-sectional view as seen generally along the line 7—7 in FIG. 6.

Figure 8:
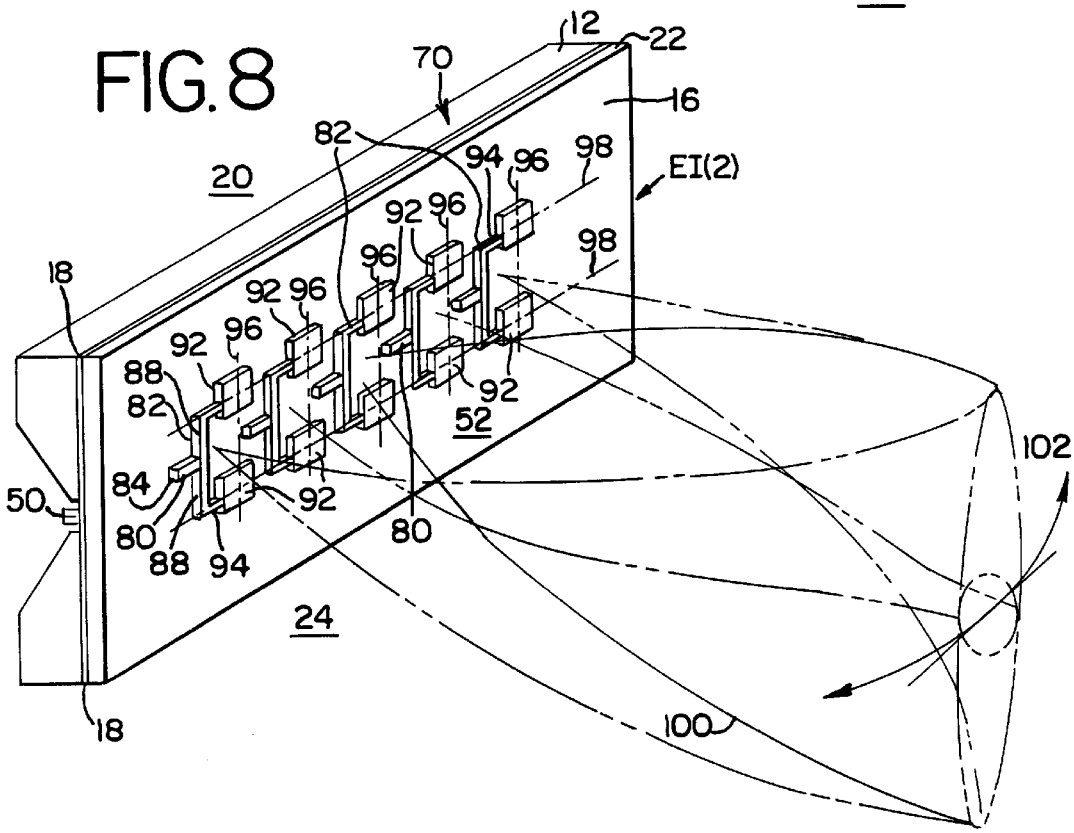

FIG. 8 is a perspective view of an output side of the antenna of FIG. 4.

Figure 9:
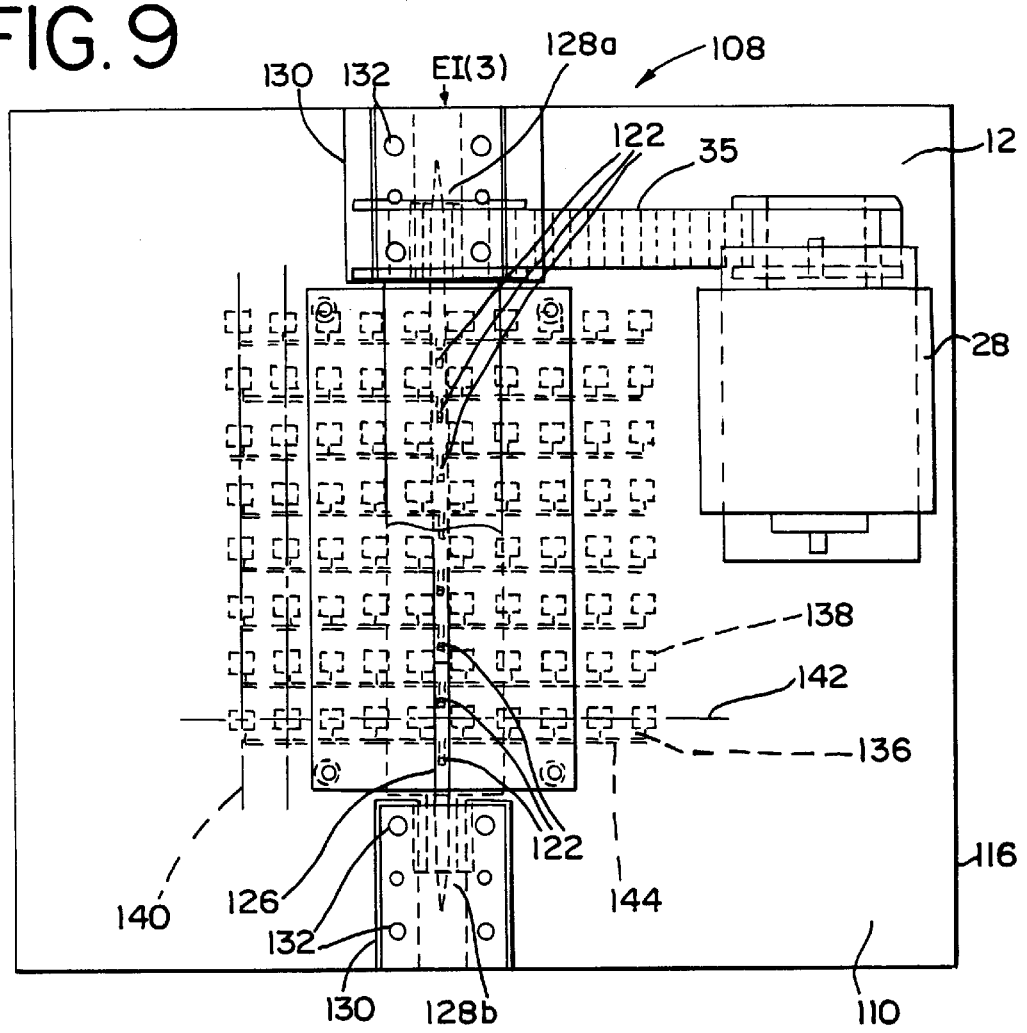

FIG. 9 is a plan view of an input side of an antenna similar to that in FIG. 4 but having a more extensive array of patches.

Figure 10:
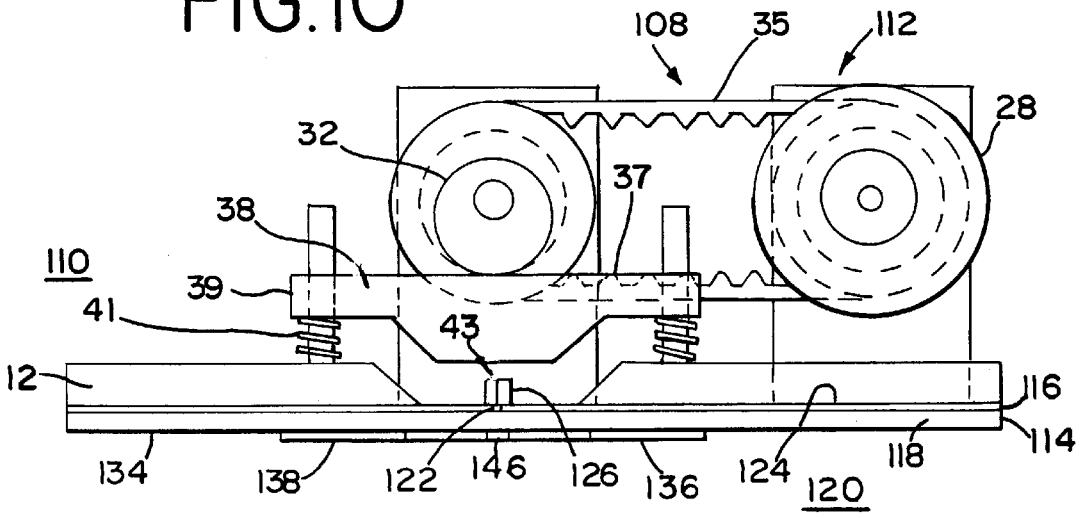

FIG. 10 is an end elevational view of the antenna of FIG. 9.

Figure 11:
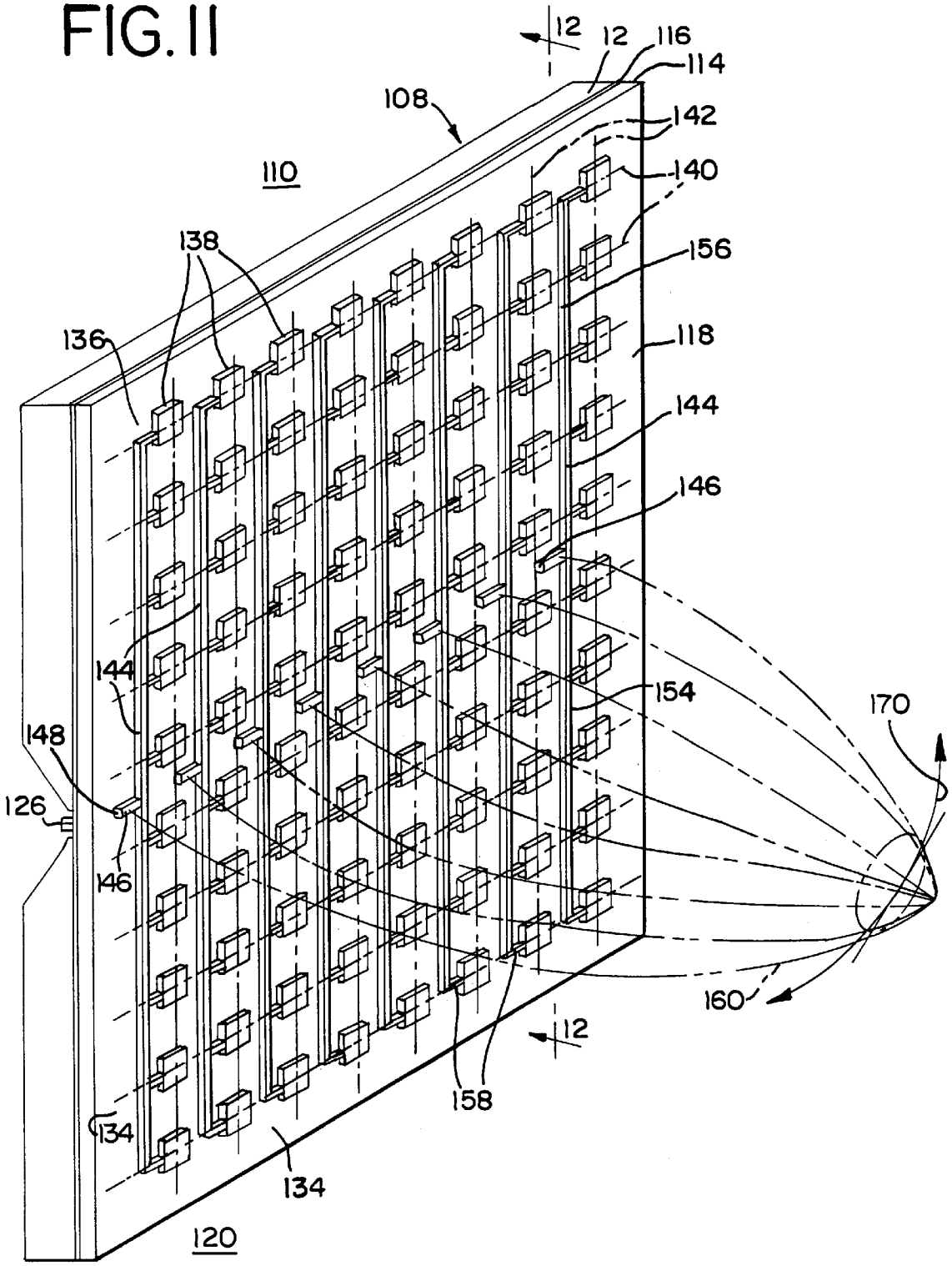

FIG. 11 is a perspective view of an output side of the antenna of FIG. 9.

Figure 12:
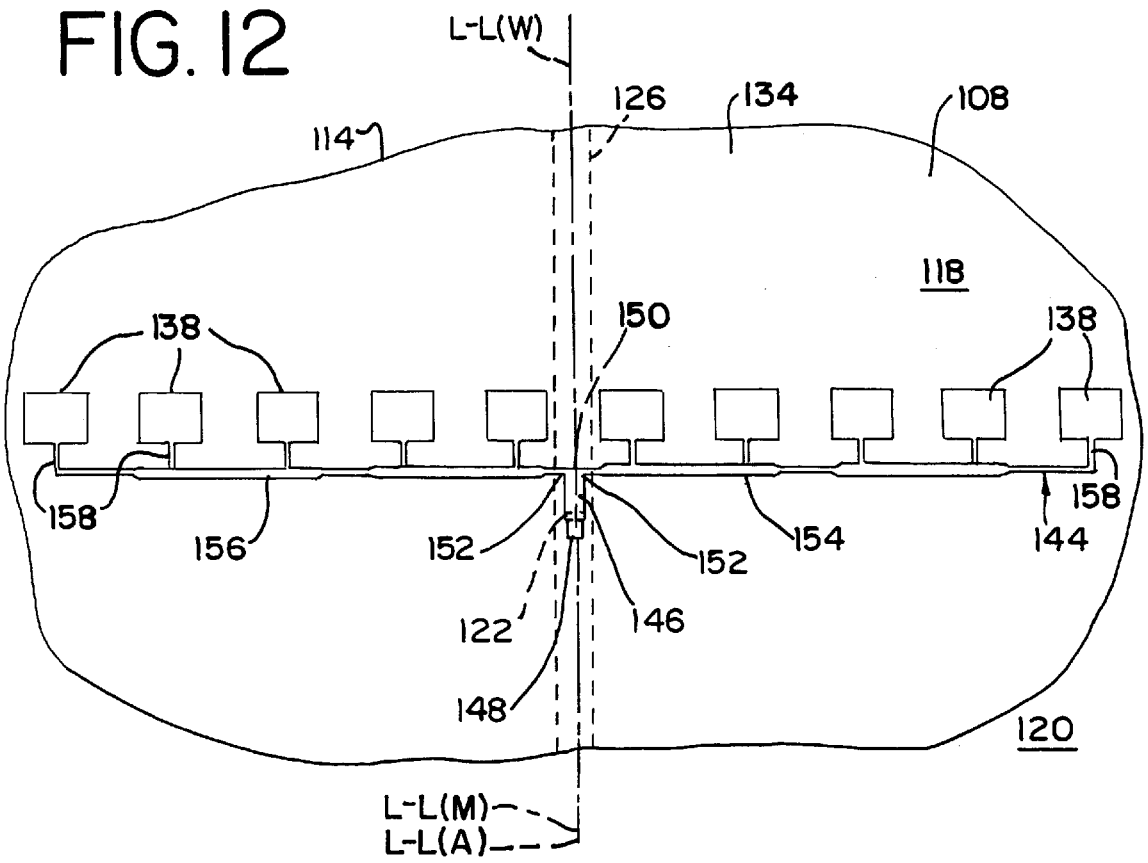

FIG. 12 is a detailed plan view of a portion of the output side of the antenna of FIG. 9 as seen generally alone the line 12—12 of FIG. 11.

Figure 13:
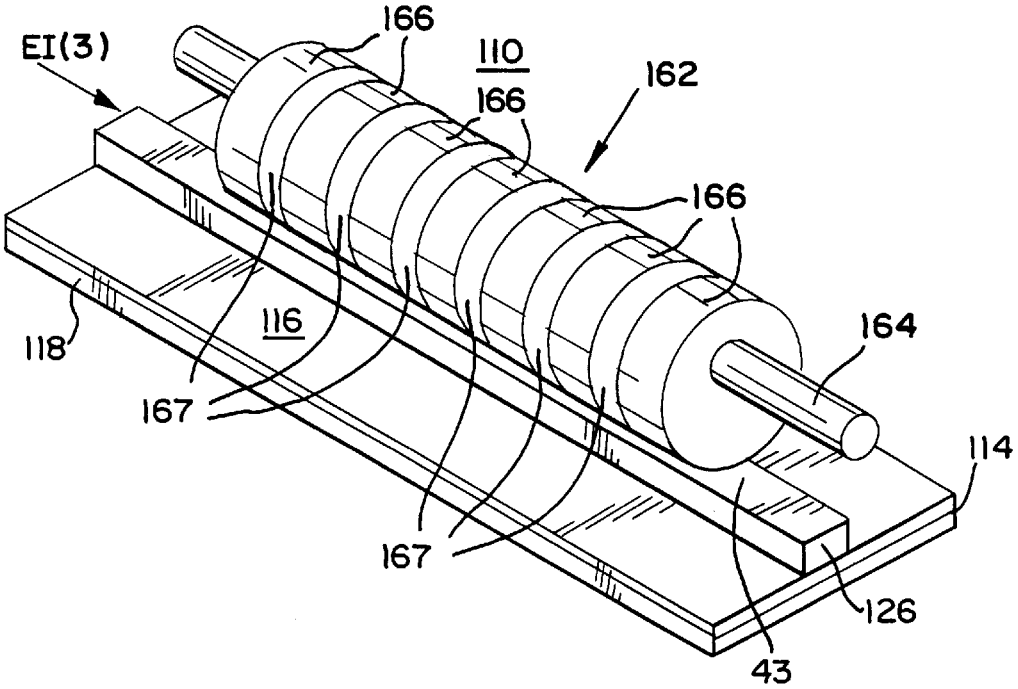

FIG. 13 is a perspective view of a rotating cam-type reflecting conductor to effect phase shifting.

Figure 14:
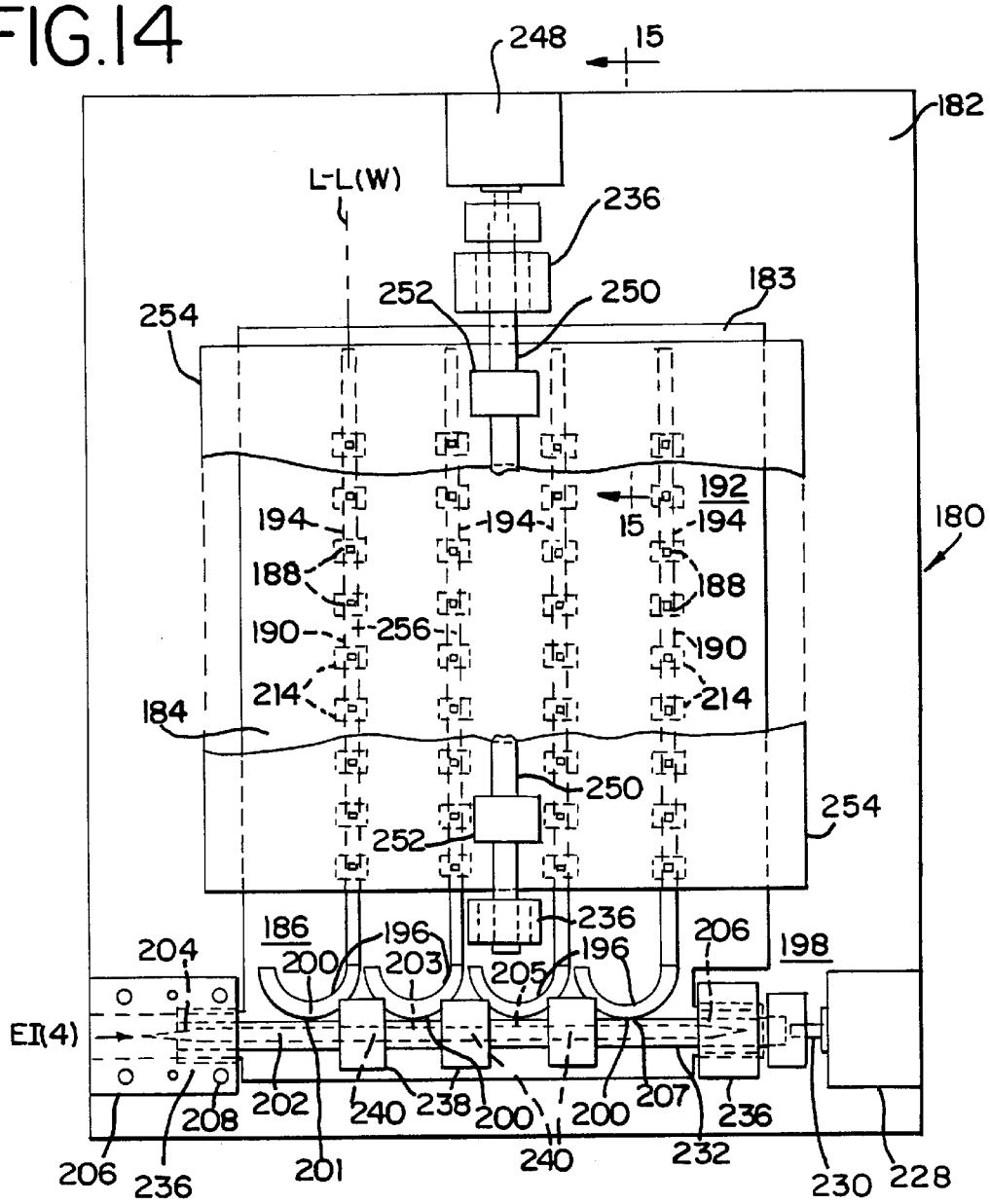

FIG. 14 is a plan view of an input side on an antenna of this invention for scanning in two directions.

Figure 15:
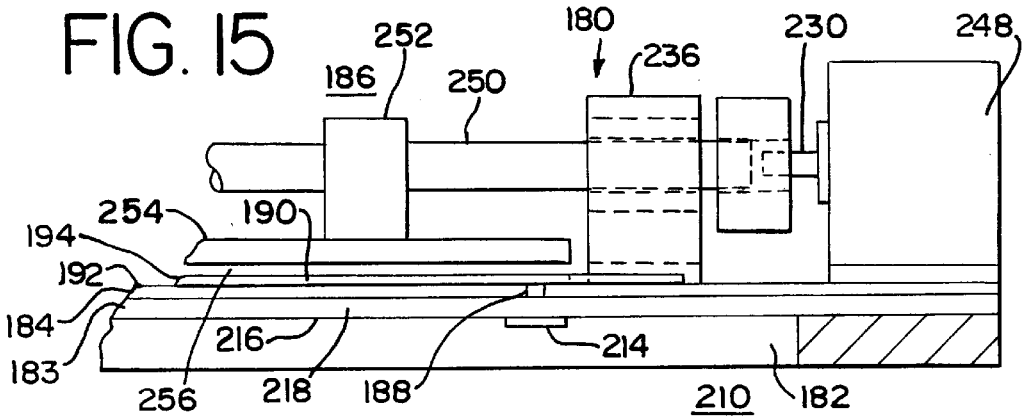

FIG. 15 is a side elevational view of a portion of the FIG. 14 antenna as seen generally along the line 15—15 in FIG. 14.

Figure 16:
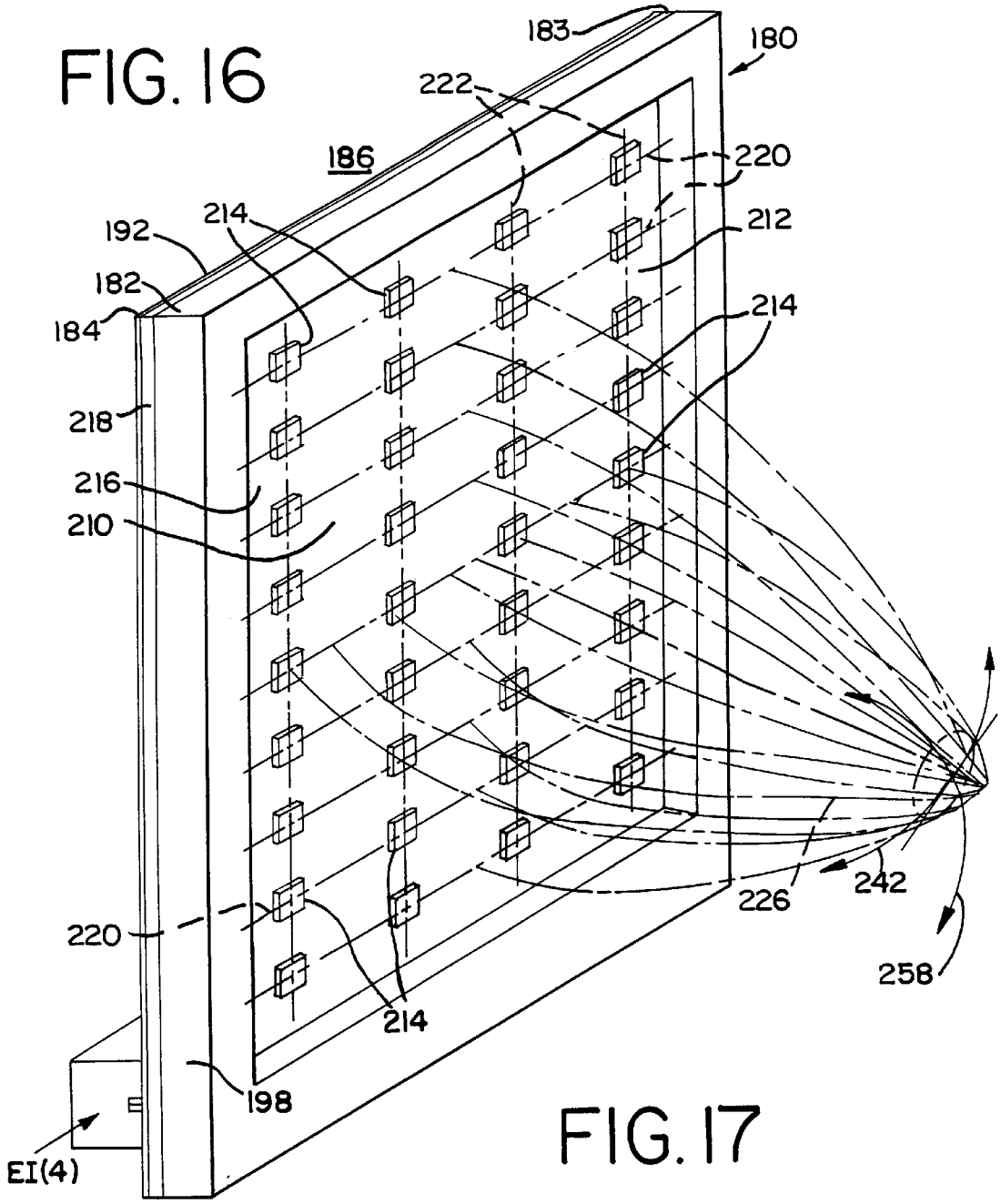

FIG. 16 is a perspective view of an output side of the antenna of FIG. 14.

Figure 17:
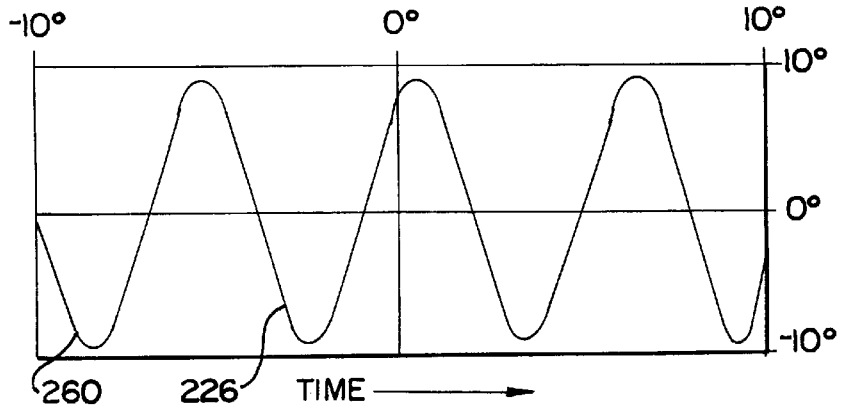

FIG. 17 is a view showing a two-directional angular path of movement of a beam emitting from the FIG. 14 antenna.

DESCRIPTION OF THE PREFERRED EMBODIMENT

Figure 2:
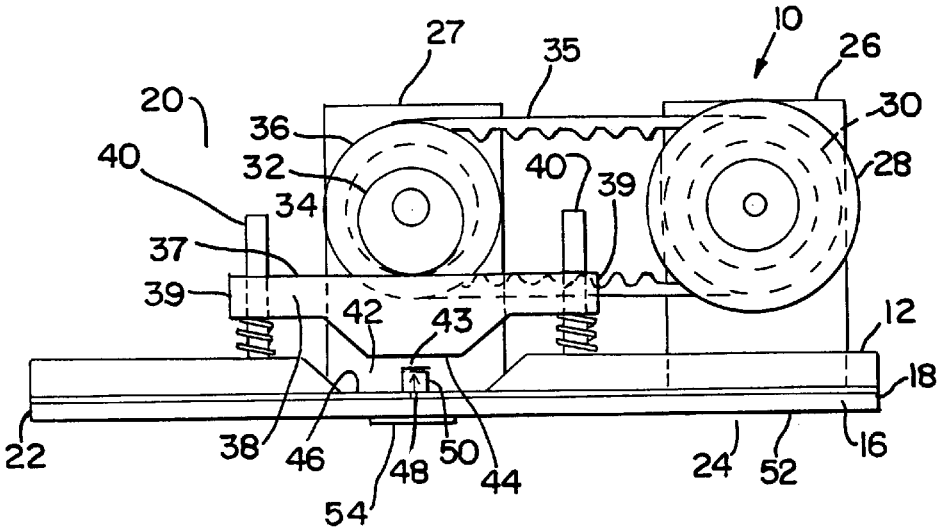
FIG. 2 is an end elevational view of the antenna of FIG. 1 where the reciprocating device now is shown.
Figure 3:
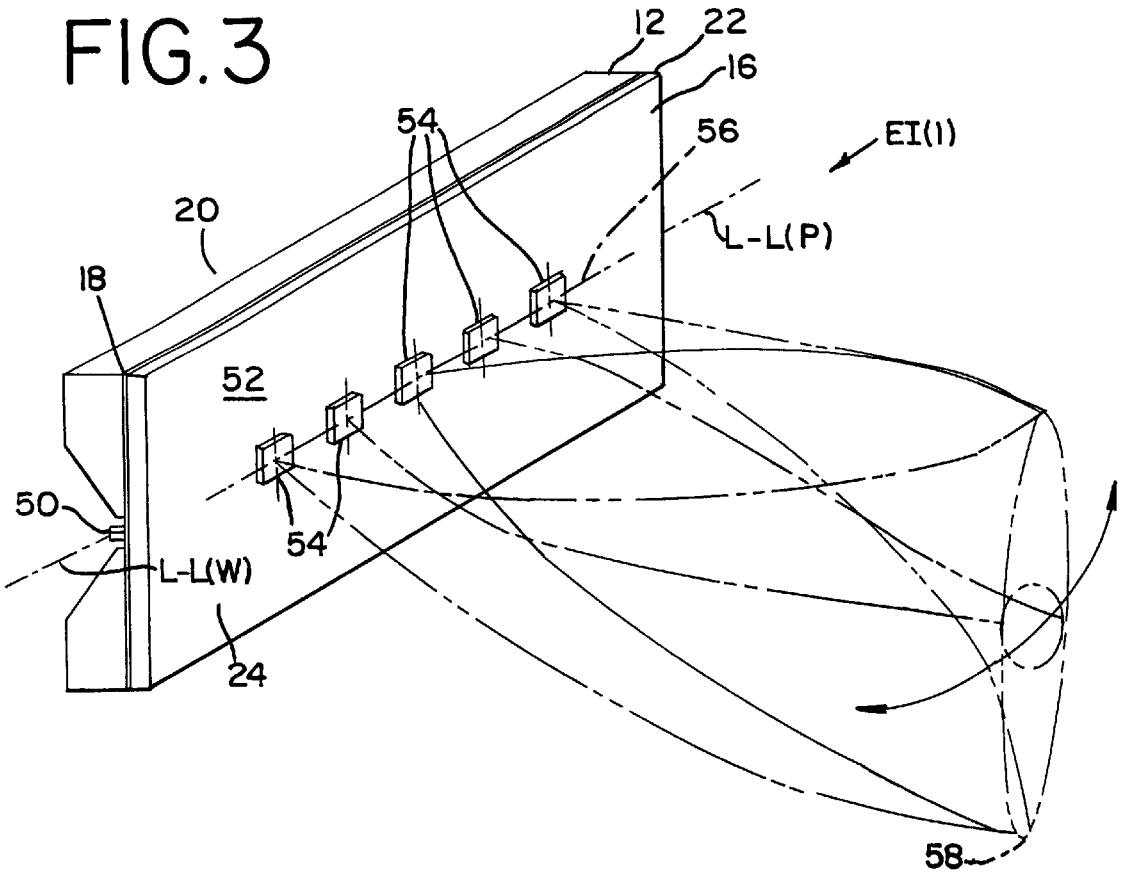
FIG. 3 is a perspective view of an output side of the antenna of FIG. 1.

An antenna of this invention, particularly adapted for use in a vehicular radar system, is shown generally in FIGS. 1–3 and designated 10. The antenna 10 includes a frame 12 that supported a laminate 16. The laminate 16 includes a conductive layer 18 on an input side 20 of the antenna 10 and a dielectric layer 22 on a output side 24 of the antenna 10.

Attached to the frame 12 and projecting rearward on the antenna input side 20 are first and second support plates 26, 27. Attached to the first plate 26 is a motor 28 having a motor pulley 30. Mounted on the second plate 27 is an eccentric drive cam 32, a drive cam shaft 34, and a drive cam pulley 36. A belt 35 then connects the motor pulley 30 to the drive cam pulley 36. The drive cam 32 is operatively attached to an outer side 37 of a reflecting conductive plate 38. Ends 39 of the reflecting conductive plate 38 are movably carried on guides 40 attached to the frame 12. As carried, a uniform space 42 is formed between an inner side 44 of the conductive plate 38 and an outer surface 46 of the laminate conductive layer 18. A uniform gap 43 then is formed between the inner side 44 of the plate 38 and a dielectric waveguide 50 carried on the laminate conductive layer outer surface 46.

As best seen in FIGS. 1 and 2, the laminate conductive layer 18 is formed with a set of spaced apart, longitudinally align ed apertures 48. The preferred aperture configuration is rectangular. As attached to the laminate conductive layer outer sur f ace 46, the waveguide 50 covers the apertures 48.

Then, as best seen in FIGS. 2 and 3, formed by etching away a conducting layer 49 and an outer surface 52 of the laminate dielectric layer 22 is a set is a set of spaced apart, rectangular shaped patches 54. The preferred patch material is copper. The patches 54 are positioned so that a longitudinal axis L-L(P) of the patches 54 aligns with a longitudinal axis L-L(A) of the apertures 48 and a longitudinal axis L-L(W) of the waveguide 50.

During operation of the antenna 10, an electromagnetic wave input EI(1) is introduced into an input end 56 of the waveguide 50. Because the antenna 10 is for vehicular use, the prescribed FCC wave frequency is 76.5 GHz. An appropriate electromagnetic wave mode launcher (not shown) may be required to connect the antenna input EI(1) to a source of energy, for example a solid state waveguide oscillator.

Figure 3A:
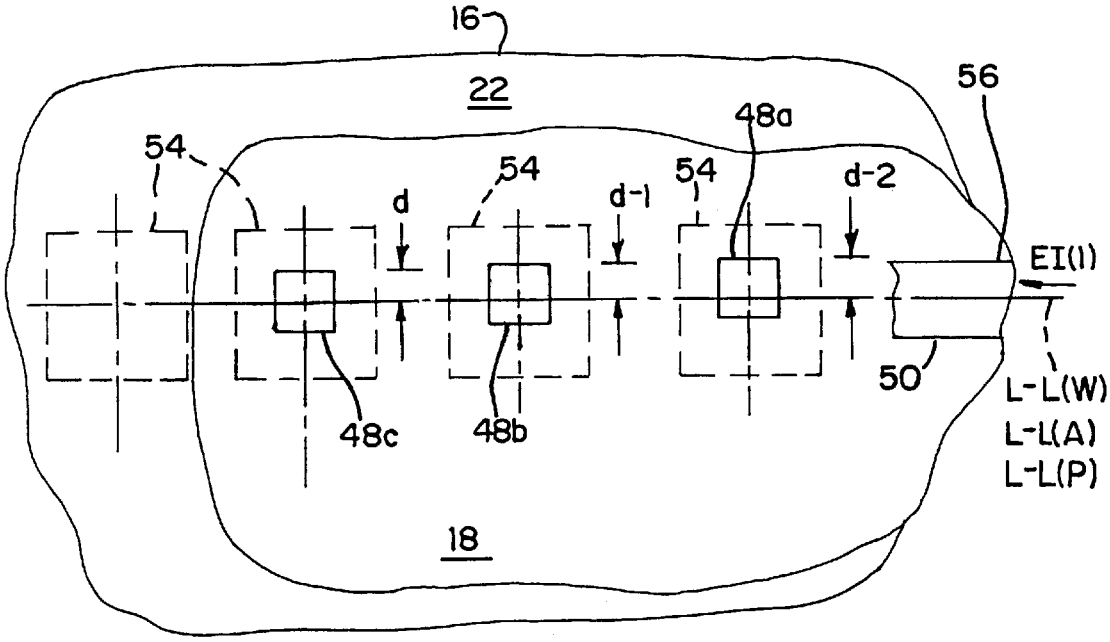

The waveguide 50 distributes this wave energy input EI(1) to the apertures 48 in the laminate conductive layer 18. Distribution of this wave energy EI is unequal. Control of the coupled energy through the apertures 48 is regulated to maximize energy radiated into the desired beam and minimize energy into undesired sidelobe beams in other directions. As may be better understood by viewing FIG. 3A, to effect these needed input differences the apertures 48 are individually laterally offset from the aperture axis L-L(A). As shown, the aperture 48*a*, which is closest to the input end 56 of the guidewave 50, is laterally offset from the aperture axis L-L(A) a distance d-2. The next closest aperture 48*b* is offset a lesser distance d-1. The next over aperture 48*c* is offset an even lesser distance d so that a center of the aperture 48*c* substantially aligns with the L-L(A) axis. An alternative method to vary energy coupling is to align the apertures 48 along the axis L-L(A) and then vary aperture dimensions.

The now distributed wave energy energizes the patches 54 by causing currents to flow on a surface of the patches 54. Electromagnetic energy radiated from the energized patches 54 combines in space to form a beam 58 of radiated energy that projects outwardly from the antenna output side 24. As seen in FIG. 3, the beam 58 has a fan-like shape at a distance from the antenna 10. The beam 58 is narrow in a plane aligning with the axis L-L(P) of the patches 54 and is wide in a plane perpendicular to that axis.

At the same time, the motor 28 is energized to rotate the motor pulley 30 to drive the belt 35 and rotate drive cam shaft 34 and drive cam pulley 36. Resulting drive cam rotation causes the reflecting conductive plate 39 to reciprocate back and forth toward the waveguide 50 to vary the gap 43. The plate guides 40 insure that the gap 43 between the plate 38 and the waveguide 50 remains uniform. This movement of the plate 36 and thus variation of the gap 43 induces a phase shift in the electromagnetic wave input EI passing through the waveguide 50 and then to the patches 54.

This phase shifting of the input EI causes the beam 58 emitting from the patches 54 in the plane in which the fan-shaped beam 58 is narrow to scan back and forth as seen in FIG. 3. The arc of scanning depends on the variation of the gap 43 and the corresponding phase shift induced in the electromagnetic wave input EI. Maximum beam scanning depends on the frequency of the EI input, the dimensions and dielectric constant of the dielectric waveguide 50 as well as the dimensional variation of the gap 43.

A further embodiment of this inventive antenna is shown generally in FIGS. 4–8 and designated 70. Where the structure of antenna 70 is like that of the antenna 10, like reference numbers are used.

The antenna 70, like the antenna 10, has a frame 12 to support a laminate 16. Again, the laminate 16 includes a conductive layer 18 on an input side 20 of the antenna 70 and a dielectric layer 22 on an output side 24 of the antenna 70.

Attached to the frame 12 and projecting rearward on the antenna input side 20 are support plates 26 and 27. Attached to the plate 26 is a motor 28 having a motor pulley 30. On the second plate 27 is mounted an eccentric drive cam 32, a drive cam shaft 34, and a drive cam pulley 36. The drive cam 32 is operatively attached to an outer side 37 of a reflecting conductive plate 38. Ends 39 of the reflecting conductive plate 38 are moveable carried on guides 40 attached to the frame 12. As carried, a uniform space 42 is formed between an inner side 44 of the conductive plate 38 and an outer surface 46 of the laminate of the laminate conductive layer 18. A uniform gap 43 then is formed between the plate inner side 44 and a dielectric waveguide 50 carried on the outer surface 46 of the laminate conductive layer 18.

As shown in FIGS. 4 and 5, the laminate conductive layer 18 is formed with a set of spaced apart, longitudinally aligned apertures 48. The preferred apertures configuration again is rectangular. As attached to the laminate conductive layer outer surface 46, the waveguide 50 covers the apertures 48 and is positioned so that the longitudinal axis L-L(W) of the waveguide 50 and a parallel longitudinal axis L-L(M) passing through centers of set of tree-shaped conducting microstrip lines or trees 82 are aligned.

Now referring to FIGS. 6 and 7, each laminate conductive layer aperture 48 is vertically aligned with a trunk section 80 of one microstrip conducting distribution tree 82. The lines 82 are attached to an outer surface 52 of the laminate dielectric layer 22 such that each aperture 48 in the laminate conductive layer in inwardly offset from an open end 84 of each tree trunk section 80 a distance equal to one-half the wavelength (of the wave in the microstrip line) at the frequency of an electromagnetic wave input EI(2) to the antenna 70. An outer end 86 of each tree trunk section 80 connects with a pair of limb sections 88 that extend respectively outward from each side of the tree truck section 80. Longitudinally offset from outer ends 90 of the tree limb sections 88 of each tree 82 is a pair of spaced apart conducting patches 92. The patches 92 of each pair are connected to the respective tree limb section outer ends 90 by a respective tree branch section 94.

As seen in FIG. 8, there are multiple pairs of patches 92 (in this case five such pairs) with each patch pair connecting with one microstrip tree 82. The patches 92 of each pair are arranged to define five columns 96 of patches 92 with the patches 92 of adjacent columns 96 then arranged to define a two rows 98 of patches 92.

During operation of the antenna 70, an electromagnetic wave input EI(2) is introduced into an input end 56 of the waveguide 50. Because the antenna 70 also is particularly adapted for vehicular use, the prescribed FCC wave frequency is 76.5 GHz. The waveguide 50 distributes this wave energy input EI(2) to the apertures 48 in the laminate conductive layer 18.

The now divided wave energy EI(2) then passes through the apertures 48 to the trunk section 80 of each microstrip distribution tree 82. The electromagnetic wave EI(2) portion in each trunk section 80 again divides to energize each pair of patches 92 by passing through connecting tree limb sections 88 and branch sections 94. Radiated electromagnetic energy from the energized patches 94 combines to form a beam 100 of radiated energy that projects outwardly from the output side 24 of the antenna 70. As seen in FIG. 8, at a distance from the antenna 70 the beam 100 is fan-shaped such that the beam 100 vertically is more broadly focused and horizontally is more narrowly focused.

Concurrent with the EI(2) wave input, the motor 28 is energized to rotate the drive cam 32. Cam rotation causes the reflecting conductive plate 38 to reciprocate back and forth toward the waveguide 50 to vary the gap 43. The plate guides 40 insure that the gap 43 between the plate 38 and the waveguide 50 remains uniform over the length of the waveguide 50 during plate movement. Movement of the plate 38 induces a phase shift in the electromagnetic wave input EI(2) passing through the waveguide 50 and then to the patches 94 through the microstrip distribution trees 82. Phase shifting of the input EI(2) causes the beam 100 emitting from the patches 94 to scan back and forth in an arcuate shaped path 102. A plane of the path 102 aligns with the axis L-L(M) of the microstrip lines 82. When the antenna 70 is scanning, the beam 100 may readily reflect from an object, for example another vehicle, 100 meters in front and 10 meters on each side of the antenna 70.

The degree of arc spanning depends on the variation of the gap 43 and corresponding phase shift induced in the electromagnetic wave EI(2). Maximum beam scanning depends on the frequency of input EI(2), the dimensions and dielectric constant of the waveguide 50 as well the dimensional variations of the gap 43.

A still further embodiment of this inventive antenna is shown generally in FIGS. 9–12 and designated 108. As seen in FIG. 9 and 10, the antenna 108 includes operative rotating means 112 to effect phase shifting of an electromagnetic wave input EI(3) to the antenna 108.

Similar to the antennas 10 and 70, the antenna 108 includes a frame 12. Attached to the frame 12 is a laminate 114 having an conductive layer 116 on the input side 110 of the antenna 108 and a dielectric layer 118 on an output side 120 of the antenna 108.

As seen in FIGS. 9 and 10, the laminate conductive layer 116 is formed with a set of spaced apart, rectangular apertures 122. Aligning with the apertures 112 and attached to an outer surface 124 of the laminate conductive layer 116 is a further elongated dielectric waveguide 126. End **128*a*, 128*b* of the waveguide 126 is pointed and contained in a channel-shaped conductive mode launcher 130. The launchers 130 in turn are respectively held by screws 132 secured in the frame 12. The launcher 130 at an input end 128*a* of the waveguide 126 allows connection of an electromagnetic source to the launcher 130. The launcher 130 at the opposite end 128*b* of the waveguide 126 is primarily for test purposes to determine the small percent of energy reaching this end 128*b* of the dielectric waveguide 126. In practice this end launcher 130 may be removed. The pointed end 128*b* of the dielectric waveguide 126** may be coated with a liquid absorbing substance to absorb energy and prevent unwanted energy reflection.

As then best seen in FIGS. 9, 11 and 12 on an outer surface 134 of the laminate dielectric layer 118 on the output side 120 of the antenna 108 is a grid-like array 136 of spaced apart patches 138. There are eighty patches 138 arranged in ten parallel rows 140 and eight (8) parallel columns 142. The rows 140 and columns 144 are positioned perpendicular.

The patches 138 in each column 142 are connected in parallel to a microstrip wave distribution tree 144. The trees 144 are attached to the laminate dielectric layer outer surface 134. Because there are eight columns 142, there are eight (8) distribution trees 144. Each tree 144 has a central trunk section 146 that aligns with one aperture 122 in the laminate conductive layer 116. As aligned, the respective apertures 122 are inwardly offset from an open end 148 of that tree trunk section 146. The dimension of the offset is based on a frequency of an electromagnetic wave input EI(3) to the antenna 108. The offset is one-quarter of the wavelength of the electromagnetic wave EI(3) which propagates in the microstrip tree trunk section 146. An opposite open end 150 of each tree trunk section 146 then connects with inner ends 152 of right and left aligned limb sections 154, 156. A set of ten spaced apart patches 138 is connected one each to the limb sections 154, 156 of each tree 144 by a respective branch section 158. As seen in FIGS. 9 and 12, the limb sections 154, 156 of the eight (8) distribution tree 144 are aligned parallel to each other but positioned perpendicular to a longitudinal axis L-L(W) of the waveguide 126.

To operate the antenna 108, electromagnetic wave EI(3) is inputed into the end 128*a* of the dielectric wave guide 126. Again, the antenna 108 being for vehicular use, the wave frequency is 76.5 GHz in accordance with FCC regulations. The waveguide 126 distributes this wave energy input EI(3) to the apertures 122 in the laminate conductive layer 116. Distribution of the wave energy input EI(3) is unequal. Control of the coupled energy through the aperture 122 is done to maximize energy radiated into the desired beam and minimize energy radiated into undesired sidelobes beams in other directions. As discussed above, to effect these needed input differences, the apertures 122 are individually offset respectively from an axis L-L(A) of the apertures 122. An alterative method to vary energy coupling is to align the apertures 122 along the L-L(A) axis but vary aperture dimensions.

The now divided wave energy EI(3) then passes through the apertures 122 to the trunk section 146 of each microstrip distribution tree 144. The electromagnetic wave EI(3) in each trunk section 146 again divides to energize the limb sections 154, 156 of that tree 144. The now further divided input wave EI(3) then flows through the branch sections 158 to the connecting patches 138 to energize the patch array 136 of eighty patches 138. It should be understood that other patch arrays comprising different a different number of rows 140 and columns 142 may be used. In general, the number of patches 138 in the rows 138 and columns 140 is selected to achieve a desired beam angle in each of the planes of the beam. Available design procedures to determine beam angles are not affected by the use of aperture coupling in the laminate conductive layer 116, by the dielectric feed line method, nor by the phase shift scanning method.

Electromagnetic energy from the energized patches 138 combines to form a beam 160 of radiated energy that projects outwardly from the output side 120 of the antenna 108. As seen in FIG. 11, the beam 160 is both vertically and horizontally focused; the half-power beamwidth in each plane depends on the patch separation and the number of patches 138 in the rows 140 and columns 142.

Concurrent with the EI(3) wave input, a motor 28 of the antenna 108 is energized to rotate the phase-shifting device 112, see FIG. 10. The rotation of a drive cam 32 of the device 112 against an outer surface 37 of a movable conductor 38 of the device 112 causes motion of the conductor 38 against springs 41 such that a gap 43 between the conductor 38 and the dielectric waveguide 126 of the antenna 108 is varied. Typical variation of this gap 43 is from 0.001 to 0.050 in. to achieve typical beam scanning of 20 degrees in a plane of the dielectric waveguide 126.

An alternate method to achieve variation of the gap 43 is to locate a rotating reflecting conductor cam device 162, shown typically in FIG. 13, directly over the dielectric waveguide 126. This cam device 162 includes a conductor cam shaft 164 that is operatively connected to a conductor cam pulley, belt, and a motor pulley of a motor (not shown). Carried on the conductor cam shaft 164 is a set of like-eccentrically positioned reflecting conductor cams 166. The conductor cams 166 are separated by spaces 167 so that the conductor cams 166 locate between adjacent apertures 122 in the laminate conductive layer 116. As spaced apart, only seven conductor cams 166 are required for the eight apertures 122. The spaces 167 between the conductor cams 166 align respectively with the apertures 122 to minimize the effect of the cam presence as the cams 166 rotate on the coupling of energy through the apertures 122.

As the conductor cams 166 rotate to increase and decrease the gap 168 between the cams 166 and the waveguide 126, the conductor cams 166 induce a phase-shifting in the electromagnetic wave input EI(3) passing through the waveguide 126. The EI(3) wave input to the patches 138 then likewise is shifted in phase causing the beam 160 emitting from the patches 138 to scan back and forth in an arcuate shaped path 170. The path 170 of beam movement remains substantially aligned with the waveguide axis L-L (W) and is proximately 20 degrees wide. When the antenna 108 is scanning, the beam 160 readily reflects from objects, for example other vehicles, a far as 100 meters in front and 10 meters on each side of the antenna 108 in front of the vehicle on which the antenna 108 is mounted.

A two-directional antenna of this invention, capable of beam scanning in both planes of the array, is shown in FIG. 14–16 and designated 180. As seen in FIG. 14, the antenna 180 includes a frame 182. Positioned within the frame 182 is a laminate 183 having a conductive layer 184 positioned on an input side 186 of the antenna 180 and a dielectric layer 218 positioned on an output side 210 of the antenna 180. The laminate conductive layer 184 is formed with four sets of spaced apart, aligned rectangular apertures 188. Each set of apertures 188 then is covered by a secondary dielectric waveguide 190 attached to an outer surface 192 of the laminate conductive layer 184.

Each secondary waveguide 190 is defined by an elongated portion 194 positioned over a respective set of the apertures 188 and a connecting arcuate portion 196 positioned in a border area 198 of the frame 182.

Located next and spaced from outermost points 200 of the waveguide arcuate portions 196 is a primary waveguide 202. As positioned, respective primary gaps 201, 203, 205, and 207 are formed between the primary waveguide 202 and the outermost points 200 of each arcuate portion 196 of the secondary waveguides 190. These primary gaps 201–207 are not the same. The size of the primary gaps 201–207 controls the percent coupling level of electromagnetic energy in the secondary waveguides 190. The benefit of controlling the percent coupling level in the secondary waveguides 190 is to maximize the energy in the desired beam of radiated energy from the antenna 180 and minimize the energy radiated into undesired sidelobes directions. Input end 204 of the primary waveguide 202 is carried in an channel of an electromagnetic wave mode launcher 206 secured to the frame 182 by screws 208.

The output side 210 of the antenna 180 is shown in detail in FIG. 16. The antenna output side 210 includes a grid-like array 212 of conducting patches 214. These patches 214 are attached to an outer surface 216 of the dielectric layer 218 of the laminate 183. The patch array 212 is defined by eight rows 220 and four columns 222 with the rows 220 and columns 222 with the rows 220 and the columns 222 positioned perpendicular. The patches 214 in respective columns 222 are located to align with the apertures 188 covered by the respective waveguides 190.

The rectangular apertures 188 are of like size along the length of the conducting plane under the secondary dielectric wave guides 190. However, it is desirable to control the percent of energy which couples through the apertures 188 from the secondary waveguides 190. This control (reduced percentage) is obtained by moving the center of the aperture 188 laterally from the center axis of the apertures 188 which is parallel to the axis of the patches 214. Standard analysis is used to compute the desired percent coupling value for each of the nine apertures 188 and also how far to displace the center of the aperture 188 from the center of the secondary dielectric waveguide 190 to obtain the desired percent coupling for each of the apertures 188.

The antenna 180 is operated by introducing an electromagnetic wave EI(4) into the input end 204 of the primary dielectric waveguide 202. Where the antenna 180 is adapted for vehicular use, the frequency of the energy input EI(4) is 76.5 GHz in accordance with FCC regulations. The primary waveguide 202 distributes this wave energy input EI(4) in a non-uniform manner through the coupling gaps 201–207 to the arcuate portions 196 of the secondary waveguides 190. The now divided wave energy EL(4) then flows through the elongated portion 194 of each secondary waveguide 190 and into the respective laminate conductive layer apertures 188 to energize the patches 214 respectively aligned with those apertures 188.

Electromagnetic energy emitting from the now energized patches 214 combines to form a beam 226 of radiated energy that projects outwardly from the output side 210 of the antenna 180. As seen in FIG. 16, the beam 226 is essentially pencil-shaped that typically will have differing (half-power) beam angles in the two planes. In this case, because there are more patches 214 in the direction of the columns 222, the beam angle in the vertical plane will be smaller than in the perpendicular (horizontal) plane of rows 220.

Concurrent with the EI(4) wave input, a primary motor 228 carried by the antenna 180 on its input side 186 is energized. An output shaft 230 of the primary motor 228 is operatively connected to a primary conductor cam drive shaft 232. Ends of the shaft 232 are carried by bearing supports 236. The conductor cam drive shaft 232 is positioned parallel to and directly over the primary waveguide 202. On the primary conductor cam drive shaft 232 is a set of three spaced apart reflecting conductor cams 238 placed to align with and be spaced respectively between the outermost points 200 of secondary waveguide arcuate portions 196. As located, a primary gap 240 is formed between each conductor cam 238 and a top surface of the primary waveguide 202.

As the primary motor 228 rotates the conductor cams 238 to increase and then decease the primary gap 240, this cam movement induces a primary phase-shifting in the electromagnetic wave input EI(4) passing through the primary waveguide 202. This shifting wave of energy passes to the secondary waveguide elongated portions 194, through the apertures 188, and to the patches 214. As a result of the primary phase-shifting input to the patches 214, the electromagnetic energy emitting from the patches 214 combines to cause the beam 226 to scan side-to-side in a arcuate (horizontal) path of movement 242, see FIG. 16.

Concurrent with operation of the primary motor 228, a secondary motor 248 carried on the input side 186 of the antenna 180 is energized. An output shaft 230 of the secondary motor 248 is operatively connected to a secondary cam drive shaft 250 having ends carried by a further pair of bearing supports 236. Spaced between these bearing supports 236 is a set of drive cams 252 operatively connected to a reflecting conductor plate 254. The plate 254 is spaced from the secondary wave guides elongated portions 194 to form a secondary uniform gap 256 therebetween, see FIG. 15.

As the secondary motor 248 operates to rotate the drive cams 252, the reflecting conductor plate 254 moves back and forth toward the secondary wave guide elongated portions 194 to increase and decrease the secondary gap 256. This plate movement induces a secondary phase-shifting in the energy wave input EI(4) passing through the waveguide elongated portions 194 and then to the patches 214. Because of this secondary phase-shifting input to the patches 214, the electromagnetic energy emitting from the patches 214 then combines to cause the beam 226 to scan up-and-down in an arcuate path of movement 258, see FIG. 16.

When the beam 226 of the antenna 180 is scanning in two directions, the paths of movement 242, 258 form a combined path of beam movement 260 shown typically in FIG. 17. The path 260 of the beam 226 is in vertical and horizontal directions may be controlled by adjusting the rotational velocity of the motors 228, 248. As shown in FIG. 17, the scanning beam 226 may readily reflect from objects, for example another object or vehicle as far as 100 meters in front, 10 meters on each side, and 10 meters above and below the object or vehicle on which a radar system including the antenna 180 is mounted.

While embodiments, methods of operation, uses, and advantages of this inventive antenna have been shown and described, it should be understood that this invention is limited only by the scope of the claims. Those skilled in the art will appreciate that various modifications or changes may be made without departing from the scope and spirit of the invention. These modifications and changes may result in further uses and advantages.

What we claim is:

1. A fixed patch array scanning antenna comprising:

a body, a laminate carried by said body and defined by a conductive layer located on an input side of said antenna and a dielectric layer located on an output side of said antenna, a series of spaced apart apertures formed in said laminate conductive layer, a dielectric waveguide carried by said laminate conductive layer to cover said apertures, a set of patches carried by said dielectric layer and positioned to receive an electromagnetic wave input passing through said apertures, and a reflecting conductor movably carried by said body and positioned to form a uniform gap with said waveguide, wherein during operation of said antenna, said electromagnetic wave input is transmitted though said waveguide to pass through said apertures and energize said patches, said energized patches emit electromagnetic energy that combines to form an outwardly projecting beam, and said conductor moves toward and away from said waveguide in said gap to produce phase shifting in said electromagnetic wave in said wave guide that causes said beam to scan in a back-and-forth path of movement.

2. An antenna as defined by claim 1 and further characterized by said antenna including, reciprocating means carried by said body and operatively attached to said reflecting conductor to move said reflecting conductor toward and away from said dielectric wave guide and increase and decrease said gap.

3. An antenna as defined by claim 1 and further characterized by said antenna including, a microstrip having one end positioned to receive said electromagnetic wave from one said laminate aperture and an opposite end positioned to pass said wave to one said patch.

4. An antenna as defined by claim 3 and further characterized by, said microstrip being a distribution tree with said one end being a trunk section of said tree, said opposite end of said microstrip being a branch of said tree, said laminate aperture being aligned with said trunk section and inwardly offset from a open end of said trunk section, and said tree having a limb section connecting said trunk section to said branch section.

5. An antenna as defined by claim 3 and further characterized by, said laminate apertures being aligned, said microstrip having a tree-like shape defined by a trunk section aligned with said laminate aperture, limb sections of said microstrip connecting with an closed end of said trunk section to extend outwardly in opposite directions from said trunk section, and first and second branch sections connecting respectively to limb sections, and said set of patches including patches connecting one each to said tree branch sections.

6. An antenna as defined by claim 5 and further characterized by, said patches connecting with said tree branch sections being laterally aligned and spaced apart an equidistance on respective sides of an axis of said laminate apertures.

7. An antenna as defined by claim 1 and further characterized by said antenna including a set of aligned microstrip distribution trees, said trees carried by said laminate dielectric layer and having trunk sections aligning one each with said laminate apertures, a set of first limb sections connecting one each to closed ends of said trunk sections to extend outwardly in a first direction, a set of second limb sections connecting one each to said trunk section closed ends to extend outwardly in a second opposite direction, and said set of patches including spaced apart pairs of laterally aligned patches equispaced on each side of an axis of said apertures with said patches of said respective pairs joined respectively to said distribution tree limbs by branch sections.

8. An antenna as defined by claim 1 and further characterized by, said set of patches comprising rows and columns of spaced apart patches positioned in a grid-like array with an axis of said laminate apertures aligning with said patch columns and said axis dividing said patch rows into a first side and a second side, and a set of microstrip distribution trees having respective truck sections aligning respectively with said laminate apertures, and first and second limb sections connecting respectively said tree trunk sections, said first limb sections extending outward on said row first side to connect respectively in parallel with said patches in said row first side, and said second limb sections extending outward on said second side of said patch rows to connect respectively in parallel with said patches in said row second side.

9. A two-directional fixed array scanning antenna comprising:

a body, a laminate carried by said body, said laminate having a conductive layer located on an input side of said antenna and a dielectric layer located on an output side of said antenna, sets of aligned, spaced apart apertures formed in said laminate conductive layer, a set of secondary dielectric wave guides carried by said laminate conductive layer, said secondary wave guides having elongated portions positioned one each over one said set of laminate apertures and connecting arcuate portions, an elongated primary dielectric waveguide carried by said body and positioned equidistant from an outermost point of each said secondary waveguide arcuate portion, patches carried by said laminate dielectric layer, said patches positioned to align respectively with said laminate apertures, a primary reflecting conductor movable carried by said body to maintain a primary uniform gap with said primary waveguide, and a secondary reflecting conductor movable carried by said body to maintain a secondary uniform gap with said elongated portions of said secondary waveguides, wherein during operation of said antenna, an electromagnetic wave is inputed to said primary waveguide, said primary waveguide passes said wave to said secondary waveguides through said outermost points, said secondary waveguides then passes said wave to said respectively covered apertures, said apertures pass said wave to said respectively aligned patches to energize said patches and thereafter emit electromagnetic energy that combines to form an outward projecting beam, said primary conductor moves in a reciprocating manner to induce primary phase shifting in said wave passing through said primary waveguide, said secondary conductor moves in a reciprocating manner to induce secondary phase shifting in said wave passing through said secondary waveguides, said primary phase shifting causing said beam to scan in a first path of movement, and said secondary phasing shifting causing said beam to scan in a second perpendicular path of movement.

10. An antenna as defined by claim 9 and further characterized by said primary reflecting conductor including, a shaft positioned parallel to said primary waveguide, and a set of conductor cams carried by said shaft to locate one each between said secondary waveguide arcuate portion outermost points.

11. An antenna as defined by claim 9 and further characterized by said secondary reflecting conductor including, a conductor plate positioned over said secondary waveguide elongated portions.

12. A fixed patch array scanning antenna comprising:

a body, a laminate carried by said body and defined by a dielectric layer on an output side on said antenna joined to a conductive layer on an input side of said antenna, a series of aligned, spaced apart apertures formed in said laminate conductive layer, a dielectric wave guide carried by said laminate conductive layer to cover said apertures, a series of microstrip distribution trees carried by said laminate dielectric layer, each said distribution trees having a goalpost-like shape defined by a trunk section connecting with outward and opposing extending limb sections with said laminate conductive layer apertures respectively aligned with said tree trunk portions and positioned inward from open ends of said trunk sections, pairs of patches carried by said laminate dielectric layer, said patches of each said pair equispaced on each said of an axis of said laminate apertures and said patches of adjacent pairs being aligned with said axis, and said patches of each pair being respectively joined to respective limb sections of said distribution trees by branch sections, and a movable reflecting conductor carried by said body on said antenna input side, said conductor positioned to form a uniform gap between said reflecting conductor and said waveguide, wherein during operation of said antenna, an electromagnetic wave is transmitted though said waveguide to pass through said apertures to said microstrip distribution tree trunk sections, said trunk sections distribute said wave to said patches through said connecting limb sections and branch sections to energize said patches, said energized patches emit a radiated electromagnetic beam projecting toward from said antenna, and said reflecting conductor moves in reciprocating mode to effect phase shifting of said electromagnetic wave in said waveguide then passing to said patches to cause said beam to scan in a path of movement perpendicular to said aperture axis.

* * * * *

UNITED STATES PATENT AND TRADEMARK OFFICE

CERTIFICATE OF CORRECTION

PATENT NO. : 6,100,846
DATED : August 8, 2000
INVENTOR(S) : Li et al.

It is certified that error appears in the above-identified patent and that said Letters Patent is hereby corrected as shown below:

Title page,
After the Title of Invention and before "BACKGROUND OF INVENTION"

-- STATEMENT OF GOVERNMENT INTEREST

This invention was made with Government support under contract F30602-98-C-0039 awarded by the Air Force. The Government has certain rights in the invention. --

Signed and Sealed this

Twenty-sixth Day of February, 2002

*Attest:*

*Attesting Officer*

JAMES E. ROGAN
*Director of the United States Patent and Trademark Office*